US008671880B2

(12) United States Patent
Oshio et al.

(10) Patent No.: US 8,671,880 B2
(45) Date of Patent: Mar. 18, 2014

(54) LIQUID APPLICATION DEVICE AND INK JET RECORDING APPARATUS

(75) Inventors: Naomi Oshio, Kawasaki (JP); Osamu Iwasaki, Tokyo (JP); Yoshinori Nakagawa, Kawasaki (JP); Atsuhiko Musuyama, Tokyo (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 13/109,470

(22) Filed: May 17, 2011

(65) Prior Publication Data

US 2011/0216142 A1 Sep. 8, 2011

Related U.S. Application Data

(62) Division of application No. 11/500,447, filed on Aug. 8, 2006, now Pat. No. 7,963,245.

(30) Foreign Application Priority Data

Aug. 11, 2005 (JP) ..... 2005-233274

(51) Int. Cl.
*B05C 1/08* (2006.01)

(52) U.S. Cl.
USPC ..... 118/712; 118/46; 118/72; 118/249; 118/261

(58) Field of Classification Search
USPC ..... 118/46, 72, 249, 261, 262, 300, 118/679–681, 696, 708, 712; 347/101; 346/135.1
See application file for complete search history.

(56) References Cited

U.S. PATENT DOCUMENTS

| | | | | |
|---|---|---|---|---|
| 4,796,528 | A | 1/1989 | Sarezen | |
| 5,628,827 | A | 5/1997 | McCollam et al. | |
| 5,850,233 | A | 12/1998 | Otsuka et al. | |
| 6,183,079 | B1 | 2/2001 | Meade et al. | |
| 6,706,118 | B2 * | 3/2004 | Heink et al. | 118/697 |
| 7,963,245 | B2 * | 6/2011 | Oshio et al. | 118/679 |
| 2003/0024474 | A1 | 2/2003 | Suzuki et al. | |
| 2003/0030710 | A1 * | 2/2003 | Kasperchik et al. | 347/101 |
| 2005/0174380 | A1 | 8/2005 | Ide et al. | |
| 2005/0179720 | A1 | 8/2005 | Iwasaki et al. | |

(Continued)

FOREIGN PATENT DOCUMENTS

| | | | |
|---|---|---|---|
| EP | 0 364 685 | B1 | 11/1993 |
| JP | 63-093135 | A | 4/1988 |

(Continued)

*Primary Examiner* — Laura Edwards
(74) *Attorney, Agent, or Firm* — Fitzpatrick, Cella, Harper & Scinto

(57) ABSTRACT

The present invention provides a liquid application device and an ink jet recording apparatus each capable of reducing deterioration in application quality due to an increase in the number of times of use of a roller, thereby improving durability. The present invention includes an application roller which applies liquid to an application medium, and a liquid retention member which retains the liquid in a liquid retention space formed by making the application roller be in contact with the retention member. With this structure, a pool of the liquid is formed, with rotation of the application roller, in an area upstream of a contact area, in a rotational direction, between the application member and the retention member at a side where a surface of the application member enters the contact area therebetween.

3 Claims, 24 Drawing Sheets

(56) References Cited

U.S. PATENT DOCUMENTS

| | | | |
|---|---|---|---|
| 2006/0176325 | A1 | 8/2006 | Seki et al. |
| 2007/0034152 | A1 | 2/2007 | Nakagawa et al. |
| 2007/0035592 | A1 | 2/2007 | Oshio et al. |
| 2007/0035593 | A1 | 2/2007 | Iwasaki et al. |
| 2007/0070163 | A1 | 3/2007 | Masuyama et al. |
| 2007/0126835 | A1 | 6/2007 | Oshio et al. |
| 2007/0126836 | A1 | 6/2007 | Masuyama et al. |

FOREIGN PATENT DOCUMENTS

| | | | |
|---|---|---|---|
| JP | 63-312149 | A | 12/1988 |
| JP | 2-172554 | A | 7/1990 |
| JP | 8-58069 | A | 3/1996 |
| JP | 09-501608 | A | 2/1997 |
| JP | 2002-96452 | A | 4/2002 |
| JP | 2004-181899 | A | 7/2004 |
| JP | 2006-159670 | A | 6/2006 |

* cited by examiner

| THRESHOLD | NUMBER OF PRELIMINARY ROTATIONS |
|---|---|
| ~1 | 1 |
| 2~5 | 3 |
| 6~10 | 8 |

FIG.17

| NUMBER OF RECORDING SHEETS | NUMBER OF PRELIMINARY ROTATIONS |
|---|---|
| ～1 | 1 |
| 2～5 | 3 |
| 6～10 | 8 |
| 10～ | 10 |

FIG.20

LIQUID APPLICATION DEVICE AND INK JET RECORDING APPARATUS

This is a division of U.S. patent application Ser. No. 11/500,447, filed Aug. 8, 2006, which issued as U.S. Pat. No. 7,963,245, on Jun. 21, 2011.

BACKGROUND OF THE INVENTION

1. Field of the Invention

The present invention relates to a liquid application device and an inkjet recording apparatus, and particularly to a liquid application device for applying liquid to a medium for a certain purpose which is, for example, to promote the coagulation of pigment when recording is carried out using an ink which contains the pigment as a coloring material. The present invention also relates particularly to an inkjet recording apparatus which includes a mechanism for applying liquid to a recording medium used in inkjet recording, for a purpose which is, for example, to promote the coagulation of pigment when recording is carried out using an ink containing the pigment as a coloring material.

2. Description of the Related Art

Conventionally, in the field of printing, a configuration is known in which an area, where ink as application liquid is supplied to a roller, is sealed off (see Japanese Patent Application Laid-open No. 8-58069 (1996)). An application mechanism described in the above Japanese Patent Application is a mechanism applying ink to a roller of which a pattern of a printing plate is formed on the surface, in a gravure printing apparatus. In this apparatus, an ink chamber having two doctor blades is used. The two doctor blades extend in the longitudinal direction of the roller at positions corresponding to upper and lower portions along the circumferential surface of the roller. Moreover, elastic members are provided on both side portions of each of these two doctor blades. The ink chamber is brought into contact with the circumferential surface of the roller, and thereby, a liquid room is formed between the chamber and the roller.

In the gravure printing apparatus described in Japanese Patent Application Laid-open No. 8-58069 (1996), the elastic members provided on both side portions of each of the doctor blades are different members from the doctor blades. The elastic members are brought into contact with the roller in order to form the liquid room. Here, the position of the ink chamber having the doctor blades and the elastic members is fixed. Only with this, a contact pressure when the doctor blades and the elastic members are brought into contact with the roller is generated. A shaft having a thread groove is engaged with this ink chamber, and the ink chamber is moved by the rotation of the shaft. With the aforementioned configuration, the roller is rotated, and thereby the application liquid in the liquid room is supplied to the roller.

In the case of the apparatus described in Japanese Patent Application Laid-open No. 8-58069 (1996), since the roller is in contact with the elastic members, abrasion of the roller is caused as the roller rotates. The abrasion of the roller shortens the working life of the roller. Then, shortening of the roller working life leads to the shorter working life of the apparatus and an increase in frequency of exchange of rollers.

Moreover, the abrasion of the roller does not uniformly occur on the roller surface and the abrasion loss differs from portion to portion of the roller surface. To be more specific, as the number of rotations for applying liquid to application media is increased, a portion of the roller on which the application media pass, in other words, which has come in contact with the application media, are more abraded away than a portion of the roller where the application media do not pass. For this reason, only the portion of the roller which has come in contact with the application media becomes thin. Accordingly, the abrasion loss of the roller is increased at the portion of the roller where the application media frequently pass.

Since there are application media of various sizes such as A4, A5, A3, B5, B4 and so on in the market, a recording apparatus includes a roller with a width corresponding to the maximum width of the supportable application media, in order to handle various sizes of the application media. Taking an example of an apparatus where the right edge of the roller is used as a base along which the application medium is set, there is a remarkable difference in the frequency with which the application media pass between the base side and the opposite side (hereinafter called as a non-base side). In other words, in the case of the base side, any sizes of the application media pass without fail. In the case of the non-base side, however, some sizes of the application media do not pass, depending on the sizes. This results in causing a difference in the abrasion loss between the base side and the non-base side.

This is because a frictional force between the roller and the elastic members contacting with the roller is changed depending on the presence or absence of an application liquid, serving as a lubricant. That is, in this case, the frictional force varies with the portion of the roller where the application media pass and the portion thereof where the application media do not pass. Accordingly, the roller is abraded away at the proton where the application media frequently pass. As described above, the difference in the abrasion loss depending on the portions of the roller causes unevenness of application in one sheet of the application media.

Moreover, since the ink chamber is fixed while the elastic members are in contact with the roller, the contact pressure to the roller is changed when the diameter of the roller becomes smaller due to the above-mentioned abrasion. The change in contact pressure affects an application amount. Therefore, unevenness of the application amount to the application medium occurs for each application operation depending on the number of times of use of the roller.

SUMMARY OF THE INVENTION

An object of the present invention is to provide a liquid application device and an ink jet recording apparatus, which reduce unevenness of application due to an increase in the number of times of use of a roller, and thereby improving durability thereof.

In first aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; and rotating means for performing a rotation different from a rotation for applying the liquid to the medium, the rotating means causing the application member to rotate without contacting the medium to the application member.

In second aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; and rotating means for causing the application member to rotate without contacting the medium to the application member; wherein, the liquid is accumulated in an area at a side where a surface of the application member enters the contact area with the retention member, the area being upstream of a contact area, in a rotational direction, between the application member and the retention member, and the area being downstream of a contact area, in the rotational direction, between the medium and the application member.

In third aspect of the present invention, a liquid application device comprises: an application roller which applies liquid to a medium; a retention member which retains the liquid in a liquid retention space formed by making the application roller be in contact with the retention member; an opposite roller placed opposite to the application roller; liquid applying means which applies, by rotating the application roller, the liquid retained in the liquid retention space to a medium sandwiched in a nip area between the application roller and the opposite roller; and forming unit which forms a pool of the liquid in an area before a predetermined application, the area being upstream of a contact area, in a rotational direction, between the application member and the retention member, and the area being downstream of the nip area in the rotational direction.

In fourth aspect of the present invention, an ink jet recording apparatus comprises: the liquid application device according to the first aspect of the present invention; and recording means for recording an image on a medium by ejecting ink from a recording head to the medium to which liquid has been applied by the liquid application device.

In fifth aspect of the present invention, a recording apparatus comprises: the liquid application device according to the first aspect of the present invention; and recording means for recording an image on a medium by applying a recording agent to the medium to which liquid has been applied by the liquid application device.

In sixth aspect of the present invention, a liquid application device control method comprises the steps of: preparing the liquid application device including an application member for applying the liquid to the medium, and a retention member for retaining the liquid in a liquid retention space formed in contact with the application member, wherein liquid application device applies the liquid retained in the liquid retention space to the medium via the application member by rotating the application member; and forming a pool of the liquid in an area upstream of a contact area, in a rotational direction, between the application member and the retention member at a side where a surface of the application member enters the retention member, by causing the application member to rotate without contacting the medium to the application member.

According to the present invention, a pool of liquid is formed in an area at an outside of a liquid retention space, that is, a contact area where an application member and a liquid retention member are in contact with each other, at a side where the application member reenters the contact area therebetween. As a result, friction generated on the contact area can be reduced. Thus, abrasion of the application member can be reduced.

Further features of the present invention will become apparent from the following description of exemplary embodiments (with reference to the attached drawings).

BRIEF DESCRIPTION OF THE DRAWINGS

FIG. 17 is a view showing a relationship between thresholds and the numbers of preliminary rotations in the embodiment of the present invention;

FIG. 20 is a specific example of a look-up table of a preliminary rotation sequence in the embodiment of the present invention;

DESCRIPTION OF THE EMBODIMENTS

Detailed description will be given below of a preferred embodiment of the present invention with reference to the accompanying drawings.

First Embodiment

Figure 1:
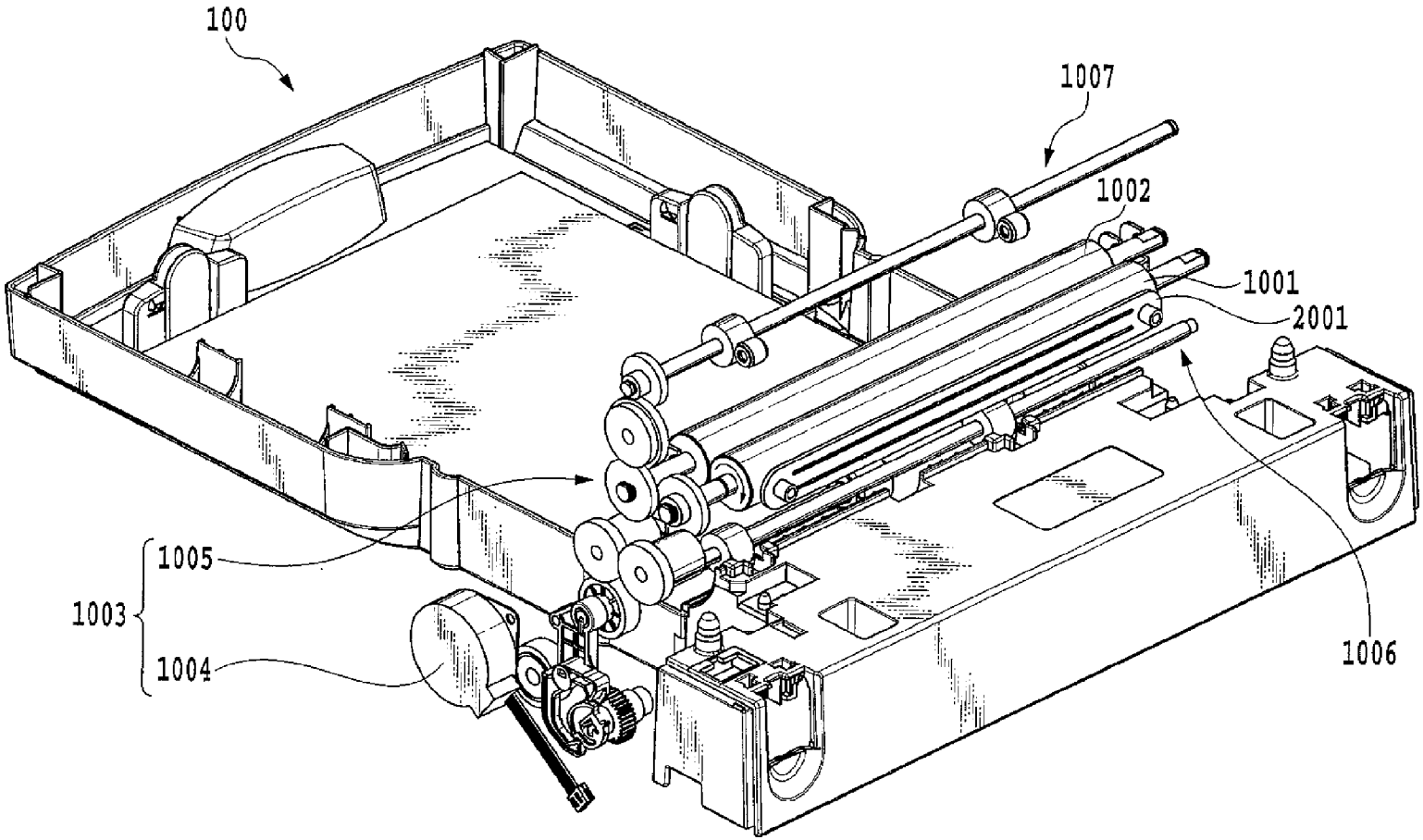
FIG. 1 is a perspective view showing an overall construction of an embodiment of a liquid application device of the present invention.

FIG. 1 is a perspective view showing an overall structure of the embodiment of a liquid application device 100 of the present invention. The liquid application device 100 shown here generally includes liquid application means for applying a predetermined application liquid to a medium (hereinafter also referred to as the application medium) which is an object to which the liquid is applied and liquid supply means for supplying the application liquid to the liquid application means.

The liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIG. 1), to be described later, supplying the liquid to the liquid retention member 2001. The application roller 1001 and the counter roller 1002 are freely rotatably supported individually by parallel shafts, each of which has both ends thereof freely rotatably fitted to a frame not shown. The liquid retention member 2001 extends substantially over the entire length of the application roller 1001, and is movably mounted to the frame via a mechanism which enables the liquid retention member 2001 to come into contact with or to separate from the circumferential surface of the application roller 1001.

The liquid application device of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

It should be noted that the application liquid used in this embodiment is a liquid used for the purpose of advancing the start of the coagulation of pigment when recording is carried out using an ink which contains pigment as a coloring material.

An example of components of the application liquid is described below.

| | |
|---|---|
| calcium nitrate tetrahydrate | 10% |
| glycerin | 42% |
| surface-active agent | 1% |
| water | the rest |

The viscosity of the application liquid is from 5 to 6 cP (centipoises) at 25° C.

Needless to say, in application of the present invention, the application liquid is not limited to the above liquid. As another application liquid, for example, a liquid which contains a component insolubilizing the dye or causing the coagulation of the dye, can be used. As yet another application liquid, a liquid which contains a component suppressing curling of the application media (the phenomenon that the media take a curved shape), can be used.

In a case where water is used in the applied liquid, the sliding property at the contact area of the liquid retention member with the application roller of the present invention will be improved by mixing a component reducing the surface tension with the liquid. In the above example of the components of the applied liquid, glycerin and the surface-active agent are the components reducing the surface tension of water.

More detailed description will now be given of construction of each portion.

Figure 2:
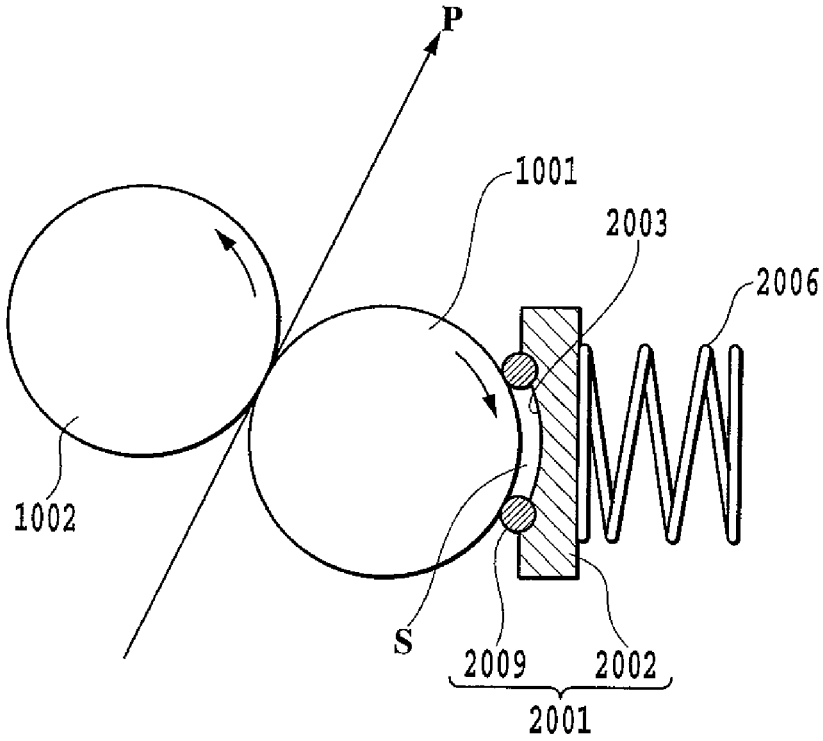
FIG. 2 is a longitudinal sectional side view showing an example of an arrangement of elements including an application roller, a counter roller and a liquid retention member.

FIG. 2 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means not shown, and rotates the application roller 1001 clockwise in the figure. This rotation makes it possible to hold, between both rollers, the application medium P to which the application liquid is applied, and to transfer the application medium P in the direction indicated by the arrow in the figure.

The liquid retention member 2001 is designed to create an elongated liquid retention space S extending across a liquid application region of the application roller 1001 while the liquid retention member 2001 abuts on the circumferential surface of the application roller 1001, biased thereto by the bias force of a spring member (pressing means) 2006. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 3 to 8.

Figure 3:
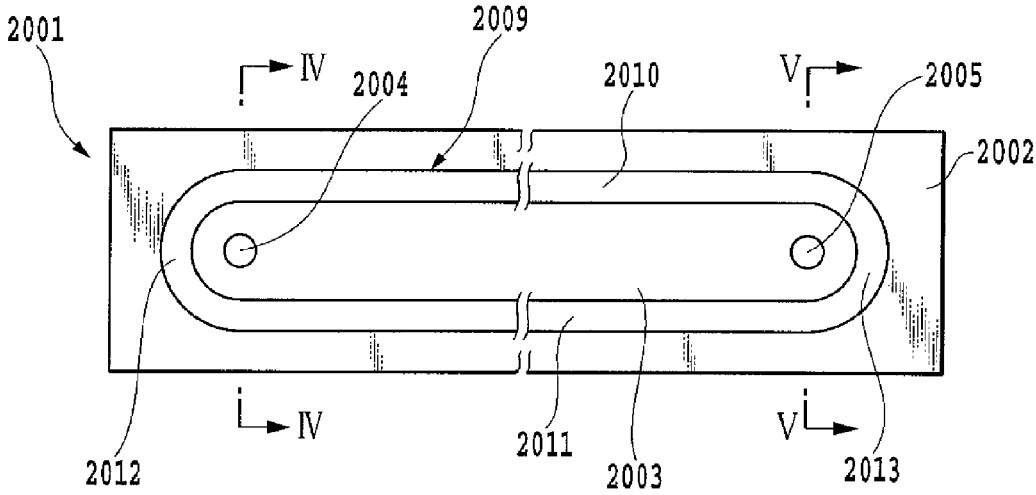
FIG. 3 is a front view of the liquid retention member shown in FIGS. 1 and 2.

As shown in FIG. 3, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space. Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid can pass through the interface between the outer circumferential surface of the application roller 1001 and the contact member 2009 and adhere the outer circumferential surface of the application roller like layer. "While the application roller 1001 is stopped, the outer circumferential surface thereof and the contact member 2009 are in a fluid-tight state" means that, as described above, the liquid is not allowed to pass through the boundary between the inside and the outside of the space. In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 4:
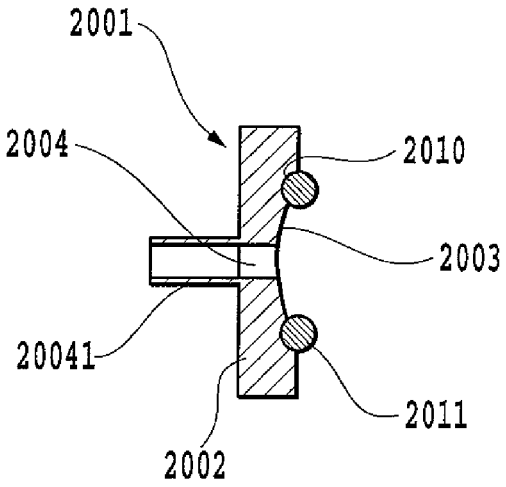
FIG. 4 is an end view showing an end obtained by cutting the liquid retention member shown in FIG. 3 along the line IV-IV.
Figure 5:
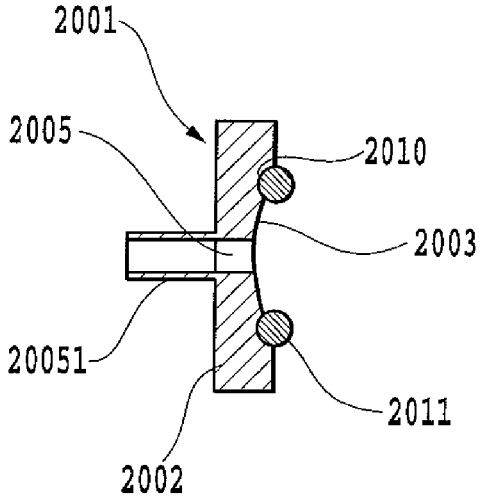
FIG. 5 is an end view showing an end obtained by cutting the liquid retention member shown in FIG. 3 along the line V-V.
Figure 6:
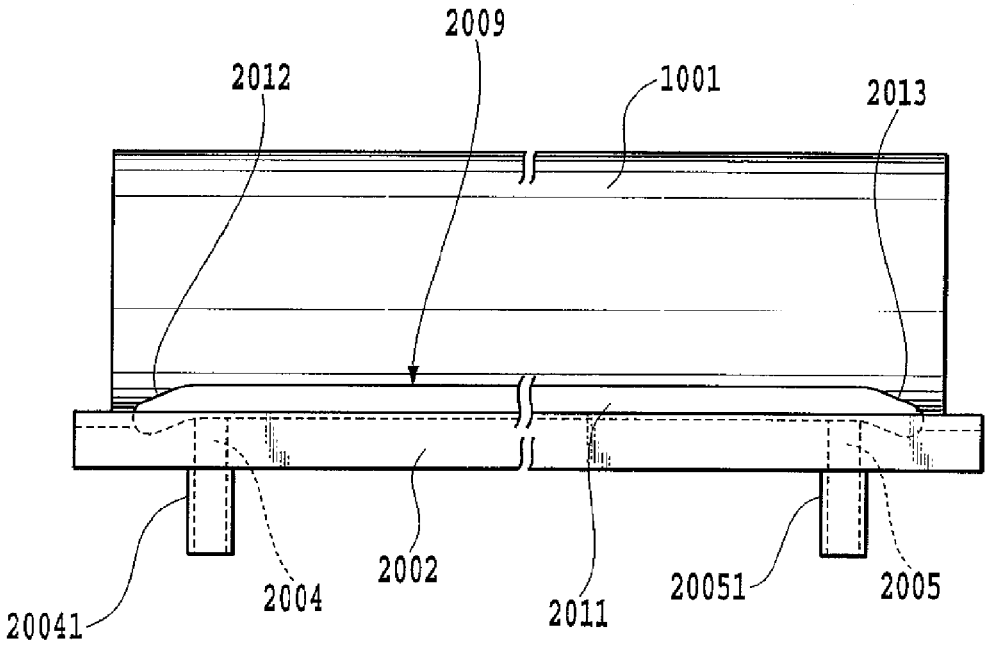
FIG. 6 is a plan view of the liquid retention member shown in FIG. 3.
Figure 7:
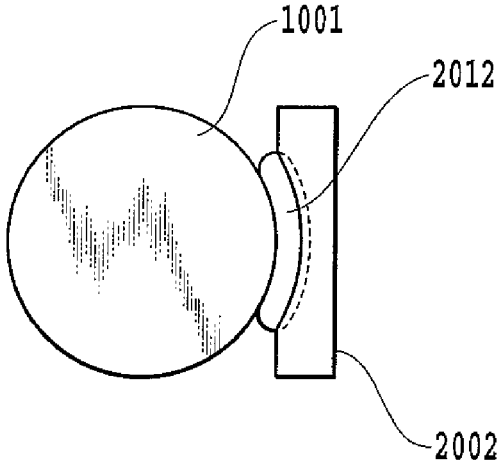
FIG. 7 is a left side view showing a state where a contact portion of the liquid retention member shown in FIG. 3 is allowed to abut on the liquid application roller.
Figure 8:
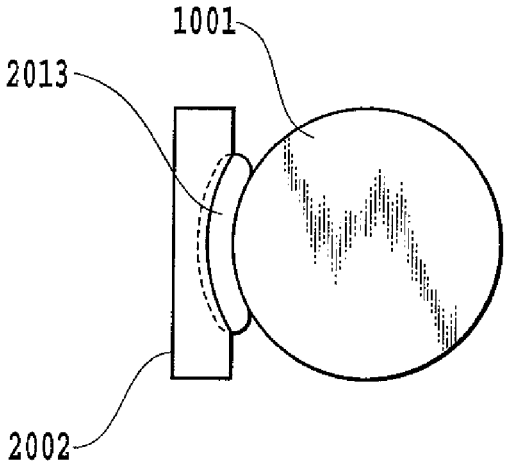
FIG. 8 is a right side view showing a state where the contact portion of the liquid retention member shown in FIG. 3 is allowed to abut on the liquid application roller.

The left and right end portions of the contact member 2009 in the longitudinal direction have a gently curved shape when viewed from any one of the front thereof (FIG. 3), the top thereof (FIG. 6), and a side thereof (FIGS. 7 and 8), as shown in FIGS. 3 to 8. As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 6 to 8.

On the other hand, as shown in FIGS. 3 to 5, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 3) of the region surrounded by the contact member 2009, and the liquid collection port 2005 is provided near the other end portion (the right end portion in FIG. 3) of the same region. The liquid supply port and the liquid collection port are not limited by the above configuration, and may be formed at any location in the space creating base. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

(Application Liquid Channel)

Figure 11:
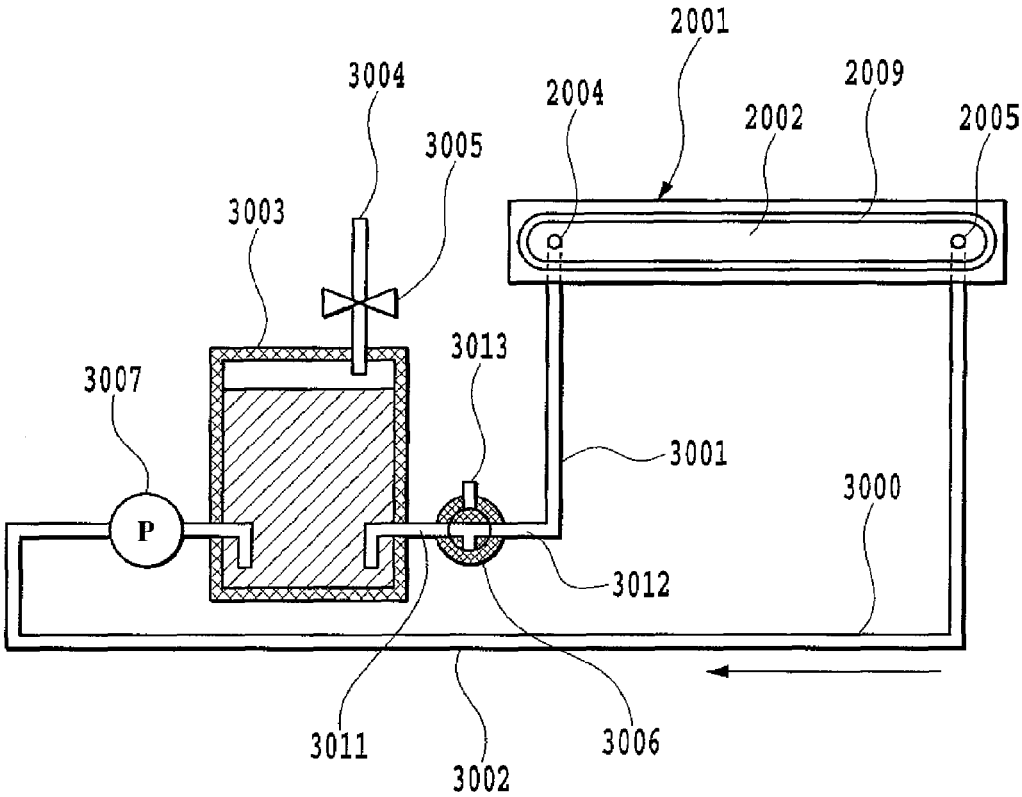
FIG. 11 is a diagram showing a schematic configuration of a liquid channel of the liquid application device in the embodiment of the present invention.

FIG. 11 is an explanatory diagram showing a schematic configuration of the liquid channel 3000 connected to the liquid retention member 2001 of the application liquid supply means.

The liquid channel 3000 has a first channel 3001 which connects the liquid supply port 2004 of the space creating base 2002 being an element of the liquid retention member 2001, and a storage tank 3003 storing the application liquid. In addition, the liquid channel 3000 has a second channel 3002 which connects the liquid collection port 2005 of the space creating base 2002 and the storage tank 3003. This storage tank 3003 is provided with an atmosphere communication port 3004, and the atmosphere communication port is provided with an atmosphere communication valve 3005 switching between an atmosphere communicating state and an atmosphere isolation state. In addition, a switching valve 3006 is provided in the first channel 3001, making it possible to switch between the state where the first channel 3001 and the atmosphere communicate with each other and the state where these are isolated from each other. In the second channel 3002, a pump 3007 is connected, which is used to force the application liquid and air to flow in a desired direction in the liquid channel 3000.

For the switching valve 3006 in this embodiment, various kinds of valves can be used as long as the valve can switch between the state where the first channel 3001 and the atmosphere communicate with each other and the state where these are isolated from each other. In this embodiment, however, a three-way valve as shown in FIG. 11 is used. The three-way valve 3006 has three ports communicating with one another. By using two of these ports, selectively, any two of a storage-tank side tube 3011, a liquid-retention-member side tube 3012 and an atmosphere communication port 3013 in the first channel 3001 can communicate with one another. Switching of this three-way valve 3006 realizes selective switches between a connection state where the tubes 3011 and 3012 communicate with each other and a connection state where the tube 3012 and the atmosphere communication port 3013 communicate with each other. In this way, it is made possible to select either the application liquid in the storage tank 3003 or the air taken in from the atmosphere communication port 3013, and to supply the selected one to the liquid retention space S created by the liquid retention member 2001 and the application roller 1001. Note that, the three-way valve 3006 is switched in accordance with a control signal from a below-described control unit 4000, so that filling or supply of the application liquid is performed.

Figure 12:
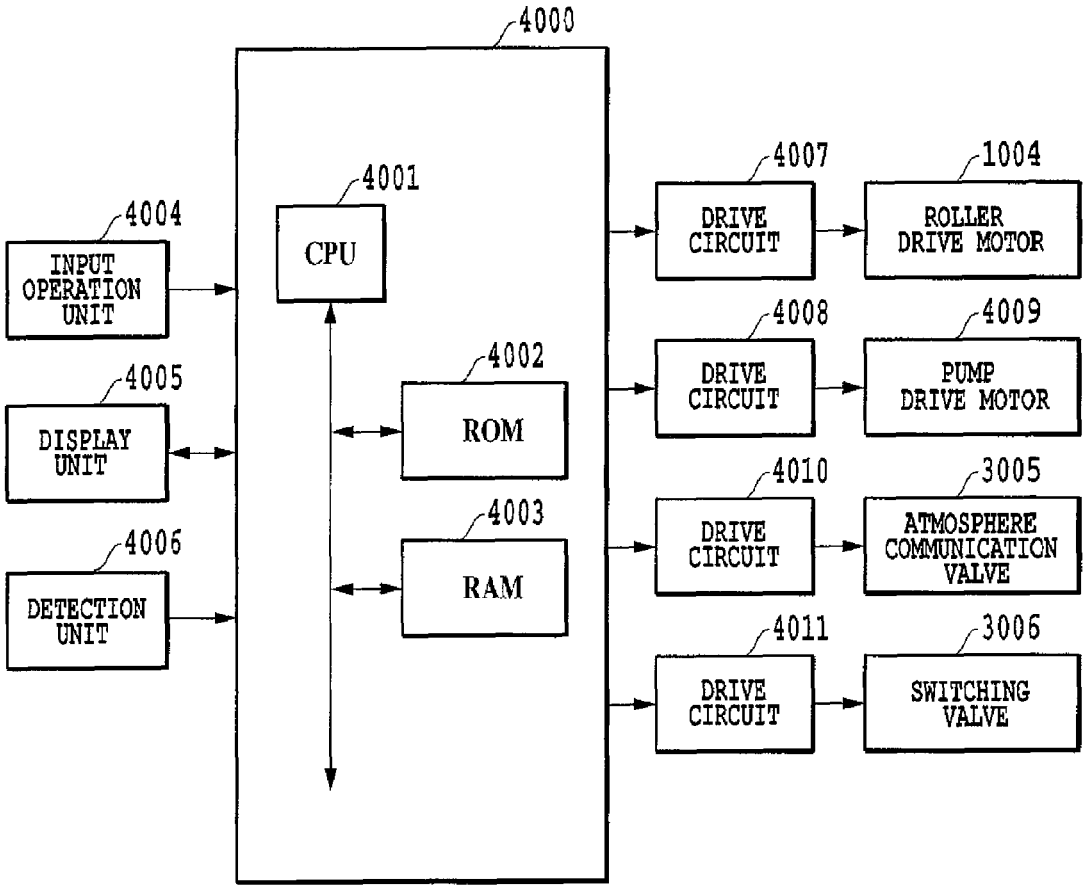
FIG. 12 is a block diagram showing a schematic configuration of a control system in the embodiment of the present invention.

In FIG. 12, reference numeral 4000 is a control unit as controlling means for controlling the whole liquid application device. This control unit 4000 includes a CPU 4001 that executes various processing, such as computation, control, and determination. The control unit 4000 also includes a ROM 4002 that stores a look-up table described later referring to FIG. 20 as well as a control program for processing described later referring to FIGS. 13, 16 and 19, and the like, the control program executed by the CPU 4001. The control unit 4000 further includes a RAM 4003 that temporarily stores input data and data generated during processing by the CPU 4001.

In addition, an input operation unit 4004, which includes a keyboard or various switches with which a predetermined command data or the like is inputted, and a display unit 4005, which displays various information, such as input, settings or the like of the liquid application device, are connected to the control unit 4000. Moreover, a detection unit 4006, which includes a sensor for detecting the position of an application medium, the operation condition of each portion or the like, is connected to the control unit 4000. The roller drive motor 1004, a pump drive motor 4009, the atmosphere communication valve 3005 and the switching valve 3006 are also connected to the control unit 4000 via drive circuits 4007, 4008, 4010 and 4011, respectively. In this embodiment, in the case where it is sometimes necessary to store information on the number of sheets recorded since the previous preliminary rotation operation is completed, the information on the number of sheets is stored in the RAM 4003.

(Liquid Application Operation Sequence)

Figure 13:
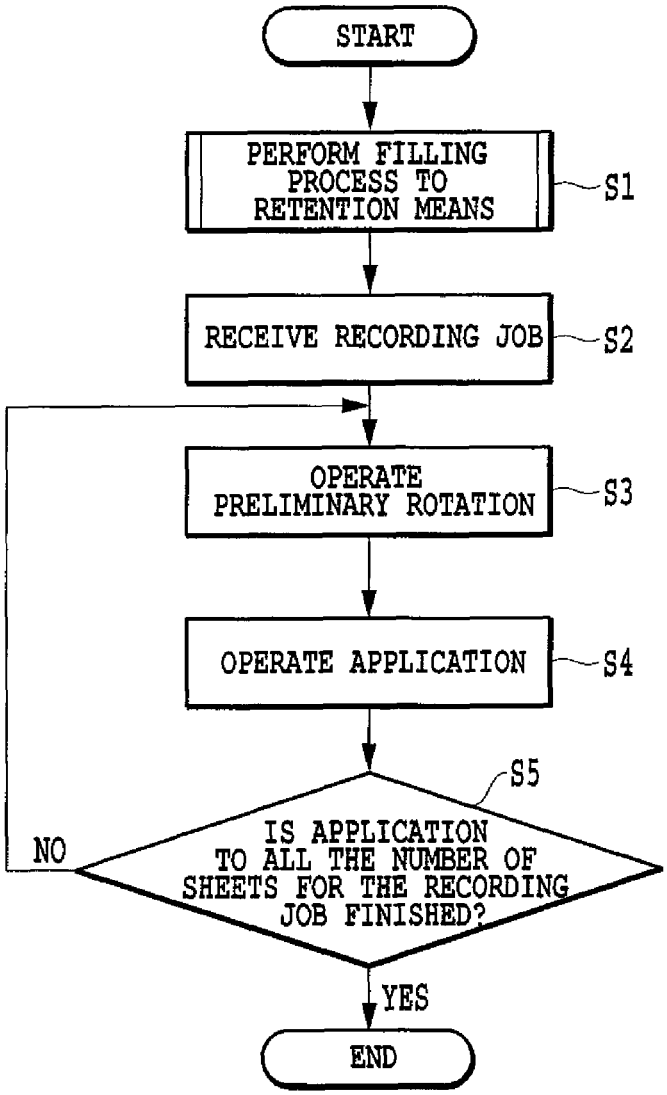
FIG. 13 is a flow chart showing a liquid-application operation sequence in the embodiment of the present invention.

FIG. 13 is a flow chart showing a procedure relating to the liquid application by the liquid application device of this embodiment. Description will be given below of each step relating to the liquid application with reference to this flow chart. Once the liquid application device is turned on, the control unit 4000 carries out the following application operation sequence in accordance with the flow chart shown in FIG. 13.

In step S1, a step of filling the application liquid into the liquid retention space S is performed. In this filling step, first of all, the atmosphere communication valve 3005 of the storage tank 3003 is opened to the atmosphere, and, at the same time, the pump 3007 is driven during a certain period of time. Thus, if the liquid retention space S, and the channels 3001 and 3002 are not filled with the application liquid, the inside air is sent to the storage tank 3003 via the pump and discharged to the atmosphere, and, at the same time, the application liquid is filled into the respective portions. If the respective portions are already filled with the application liquid, the application liquid in the respective portions flows, and an application liquid having a proper concentration and viscosity is supplied. This operation results in a state where the application liquid has been supplied to the application roller 1001, making it possible to apply the liquid to an application medium.

Preliminary Rotation Operation

On receipt of a recording job (step S2), a preliminary rotation operation is performed (step S3). The preliminary rotation operation is performed by rotating the application roller 1001. The number of rotations is decided depending on an expected volume of suppression of the abrasion loss and/or a balance between an image and throughput. Namely, the preliminary rotation operation is controlled in such a way that a predetermined amount of application liquid is accumulated to form a below-mentioned pool of application liquid.

In this embodiment, although the preliminary rotation operation is controlled by the number of rotations of the application roller, the control method thereof is not limited thereto. In this embodiment, it suffices that the application liquid is accumulated outside the liquid retention member 2001 at a return position of the application roller 1001 to the liquid retention member 2001 by the preliminary rotation operation. Accordingly, for instance, the preliminary rotation operation may be controlled by a rotation time of the application roller.

In this specification, the "preliminary rotation operation" refers to a rotation operation of the application roller, which is performed before an actual application operation to the application medium with the application roller. In other words, the preliminary rotation operation aims at accumulating the application liquid between the application roller and the contact member at the return position of the application roller to the liquid retention member.

The following will explain the preliminary rotation operation.

Figure 9:
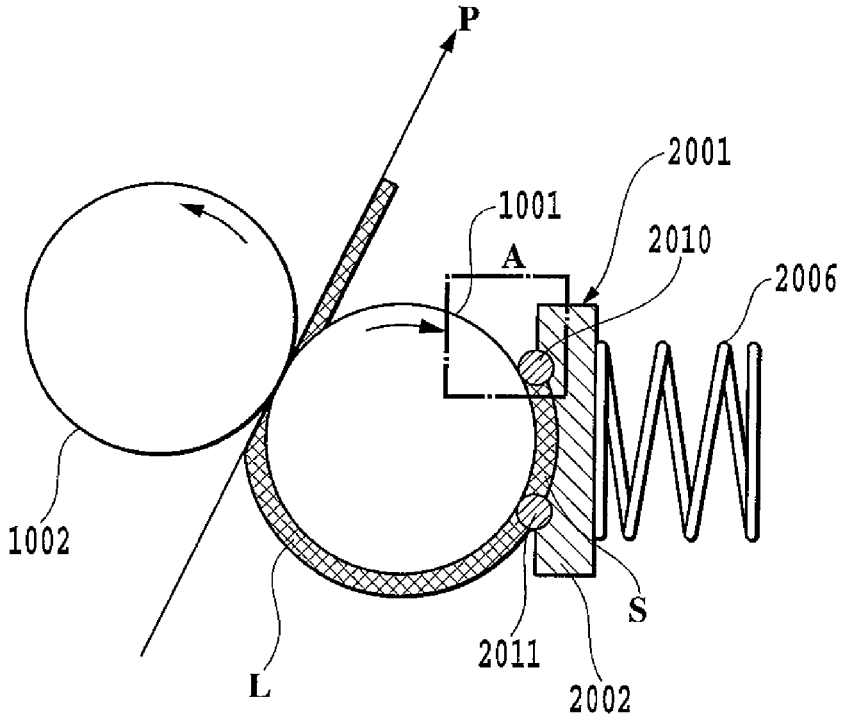
FIG. 9 is a longitudinal sectional view showing a state where a liquid retention space created by the liquid retention member and the application roller is filled with an application liquid, and the liquid is applied to an application medium as the application roller rotates in the embodiment of the present invention.

FIG. 9 is a view showing a state where a liquid retention space S is filled with an application liquid and the liquid is applied to an application medium P by rotating the application roller 1001. In FIG. 9, the cross hatched part indicates the application liquid L. It should be noted that, in this figure, the thicknesses of the layer of the application liquid on the application roller 1001 and the application medium P is expressed excessively larger than the actual thickness, for the purpose of clearly illustrating the state of the application liquid L at the time of the application.

Here, an area A indicated by a broken line in FIG. 9 is a part where the application roller 1001 reenters a contact area between the application roller 1001 and the liquid retention member 2001. As shown FIG. 9, on a portion of the application roller 1001, the application liquid sparsely remains after the application liquid is transferred to the application medium P. The area A is a place where the portion of the application roller 1001 reenters the contact area therebetween. In other words, the area A is upstream of the contact area, in the rotational direction of the application roller 1001, between the application roller 1001 and an upper edge portion 2010. Moreover, the area A is also downstream of the nip area, in the rotational direction, between the application roller 1001 and the counter roller 1002.

The application liquid also functions as a lubricant. Moreover, as specifically described later, only a small amount of application liquid is left on the application roller 1001 after the application medium passes, since the application liquid is applied to the application medium. Namely, in the area A where the application roller 1001 enters the nip area of the liquid retention space 2001 (the nip area between the application roller 1001 and the upper edge portion 2010 of the contact member 2009), the application liquid as the lubricant becomes insufficient to increase the friction in between. The friction abrades a portion of the application roller 1001 where the application medium passes. On the other hand, a portion of the roller 1001 where no application medium passes is shown as in FIG. 10. In other words, the application roller 1001 reenters the contact area therebetween with the application liquid as the lubricant in the area A, and thereby friction is not increased. Similarly the application liquid functions as the lubricant, for example, also in the case where A4 size recording paper passes on the application roller 1001 capable of handling A3 size recording paper at maximum, and no recording paper passes at the non-base side of the application roller 1001.

Figure 14:
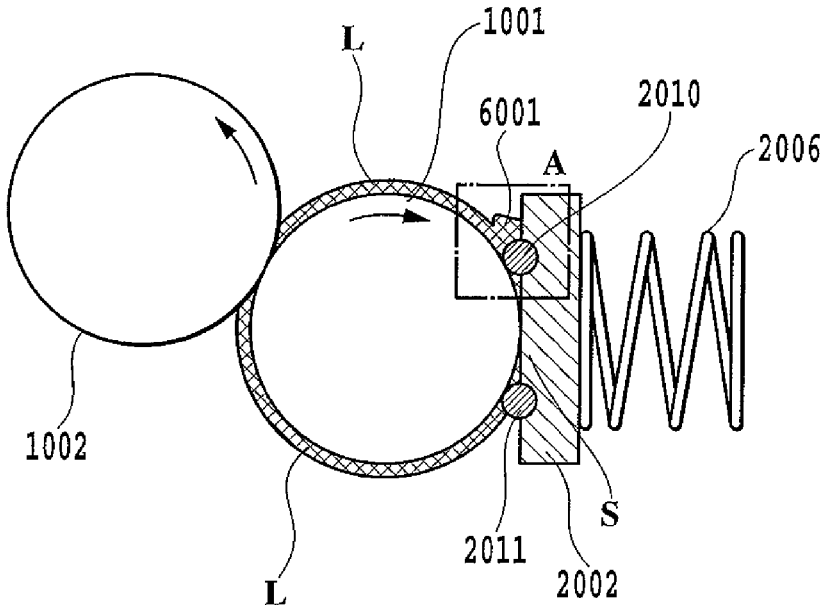
FIG. 14 is a schematic view showing that an application liquid is accumulated in a contact area between an application roller 1001 and a liquid retention member 2001 in the embodiment of the present invention.

When the application roller 1001 rotates, 100% of the application liquid existing on the surface of the application roller 1001 is not always returned to the liquid retention space S as shown in FIG. 14. This occurs in the case where no application medium exists on the application roller 1001, and also occurs on the portion of application roller where no application medium passes during the application operation. When the amount of application liquid transferred to the application roller 1001 is greater than that of application liquid to be returned to the liquid retention space S, in some cases, all the application liquid is not returned to the liquid retention space S and some amount of application liquid remains in the area A and accumulated therein. In other words, some amount of application liquid existing on the surface of the application roller is accumulated in the outside area (area A) of the liquid retention member 2001. The outside area (area A) is formed by the application roller 1001 and the upper edge portion 2010 serving as the contact member on the side where the application roller reenters the contact area therebetween. Application liquid 6001 thus accumulated in the area A functions as a lubricant.

On the portion of the application roller 1001 where the application liquid does not exist abundantly, the abrasion is likely to occur after the application medium passes thereon, as mentioned above. For this reason, in this embodiment, before the application medium is transferred, the rotation operation (preliminary rotation operation) of the application roller 1001 is performed without the application medium, as mentioned above. As a result, the above-mentioned pool of the application liquid is formed. To be more precise, the pool of the application liquid is formed in the area, which is upstream, in the rotational direction, of the application roller 1001 and the upper edge portion 2010, and which is downstream, in the rotational direction, of the contact area between the application roller 1001 and the application medium. After that, the application medium is conveyed between the application roller 1001 and the counter roller 1002. Even if the application liquid is little left on the roller when the application roller 1001 reenters the contact area therebetween after the application operation, forming the pool of the application liquid allows to supply the application liquid onto the roller surface by the pool of the application liquid. The supplied application liquid indeed functions as the lubricant to reduce the friction between the application roller 1001 and the upper edge portion 2010.

Figure 15:
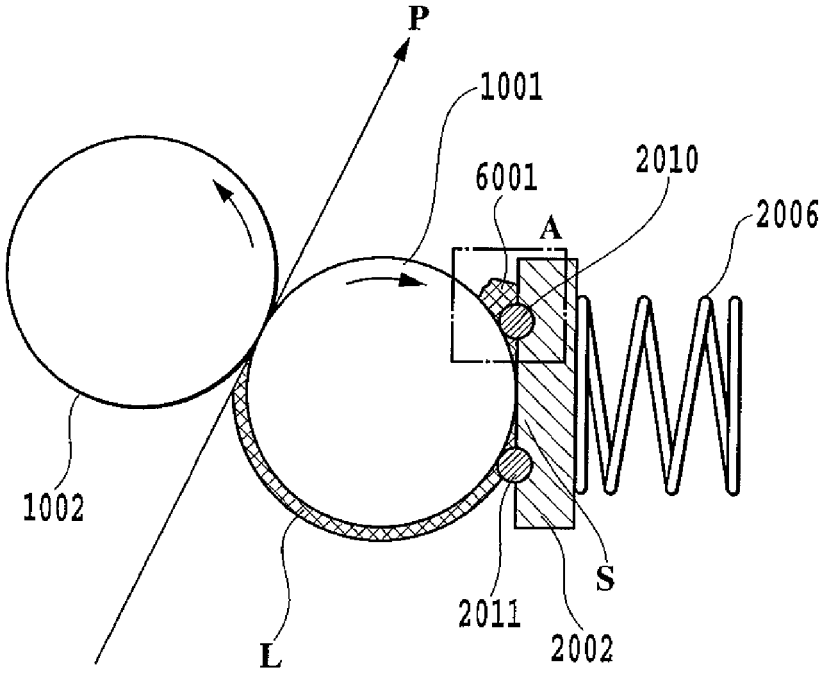
FIG. 15 is a schematic view showing that the application liquid is accumulated in the contact area between the application roller 1001 and the liquid retention member 2001 even after application to a recording medium in the embodiment of the present invention.

That is, as shown in FIG. 15, the application liquid does not exist abundantly on the application roller 1001 when the application roller 1001 reenters the contact area therebetween, as a result of the application to the application medium P. Even in this case, the application liquid is supplied to the application roller from the pool of the liquid in the contact area at the reentering side to the liquid retention member 2001. Accordingly, the friction between the application roller 1001 and the liquid retention member 2001 can be reduced. Therefore, it is possible to reduce the abrasion of the application roller.

This embodiment makes it possible to reduce the abrasion, and then to improve durability of the application roller. Accordingly, even if the number of times of use thereof is increased, unevenness of application for each application operation can be reduced. Moreover, it is also possible to reduce unevenness of the abrasive loss in the application roller 1001 depending on the locations, thereby reducing the unevenness of application to one sheet of the application media.

Application Step

When the preliminary rotation operation is finished in step S3, the pump 3007 again starts to activate and the application roller 1001 starts to rotate clockwise as shown by an arrow in FIG. 1. With this rotation of the application roller 1001, the application liquid L filled in the liquid retention space S overcomes the pressing force of the contact member 2009 of the liquid retention member 2001 against the application roller 1001, and passes through the interface between the application roller 1001 and the lower edge portion 2011 of the contact member 2009. The passed application liquid sticks to the outer circumferential surface of the application roller 1001 in a film form. The application liquid L stuck to the application roller 1001 is transferred to the contact area between the application roller 1001 and the counter roller 1002.

Subsequently, the application medium feeding mechanism 1006 transfers an application medium to the interface between the application roller 1001 and the counter roller 1002. Thereafter, the application medium is inserted between these rollers. The application medium is then transferred toward a delivery unit as the application roller 1001 and the counter roller 1002 rotate. During the transfer, the application liquid applied to the circumferential surface of the application roller is transferred from the application roller 1001 to the application medium P as shown in FIG. 9. The application of the application liquid is thus performed to the application medium (step S4). Needless to say, the means for feeding the application medium to the interface between the application roller 1001 and the counter roller 1002 is not limited to the above feeding mechanism. Any means can be used. For example, manual feeding means accessorily utilizing a predetermined guide member may be additionally used, or the manual feeding means may be used alone.

In this way, the part of an application medium P to which the liquid has been applied is transferred in the direction indicated by the arrow by the transferring force of the application roller, and, at the same time, the part of the application medium P to which the liquid has not been applied yet is transferred to the interface between the counter roller and the application roller 1001. By performing this operation continuously or intermittently, the application liquid is applied to the entire surface of the application medium.

Figure 18:
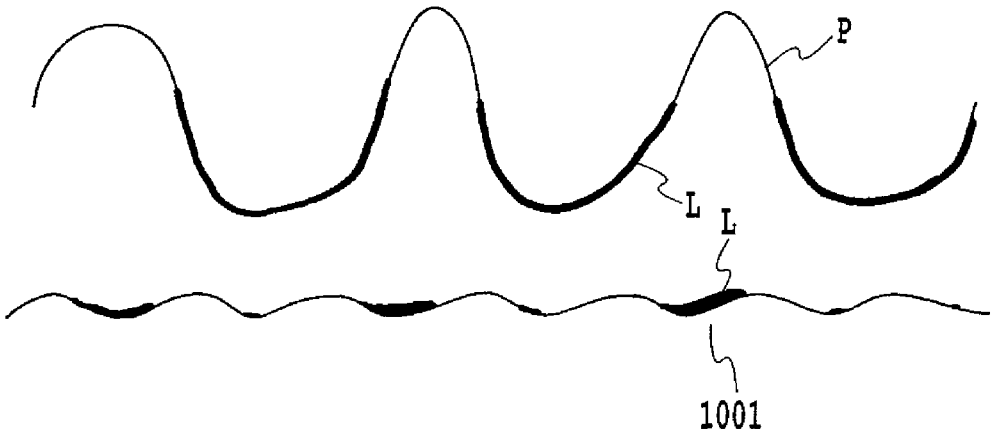
FIG. 18 is an explanatory diagram explaining an application process of a surface of a medium and an application surface when the medium is a plain paper. This figure shows a state at the downstream side of a nip area between the application roller 1001 and a counter roller 1002.
Figure 23:
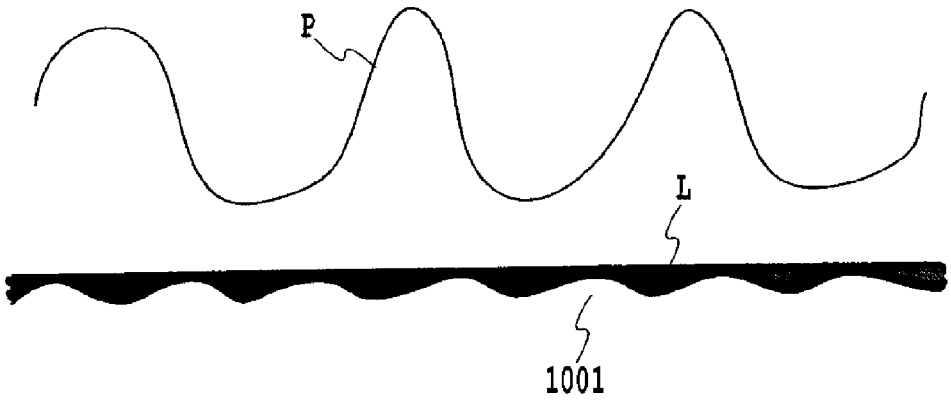
FIG. 23 is an explanatory view explaining an application process of a surface of a medium and an application surface when the medium is a plain paper. This figure shows a state at the upstream side of a nip area formed by the application roller 1001 and the counter roller 1002.
Figure 24:
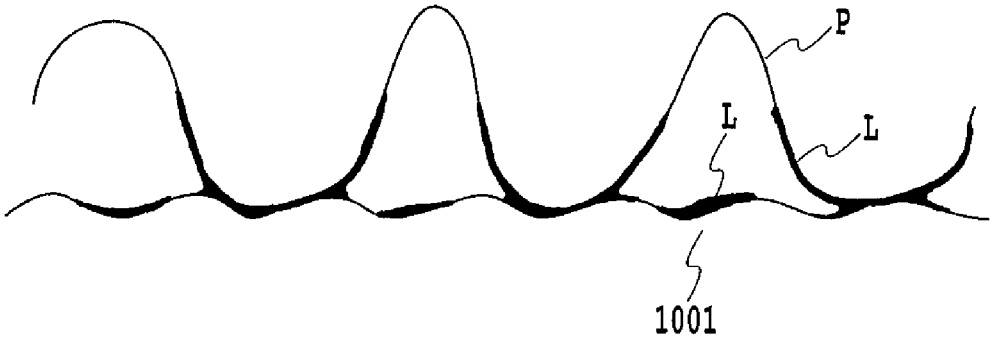
FIG. 24 is an explanatory view explaining an application process of a surface of a medium and an application surface when the medium is a plain paper. This figure shows a state of the surface of the medium P and the application surface of the application roller 1001 in the nip area formed by the application roller 1001 and the counter roller 1002.

FIGS. 23, 24 and 18 are explanatory diagrams for explaining an application process proceeding between the application surface and the surface of the medium in a case where the medium P is a plain paper. In these figures, the liquid is expressed by the regions filled in with black.

FIG. 23 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 24 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 18 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

Figure 10:
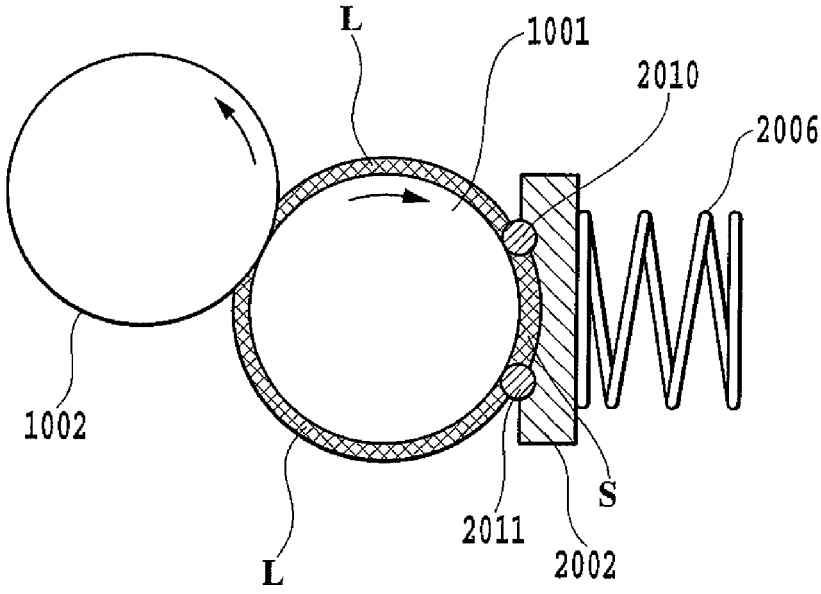
FIG. 10 is a longitudinal sectional view showing a state where the liquid retention space created by the liquid retention member and the application roller is filled with the application liquid, and the application roller is rotated with no application medium present in the embodiment of the present invention.

As shown in FIG. 10, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

Final Step

When the application to the application medium is finished in step S4, it is determined whether application to all the number of sheets required by the recording job received in step S2 is finished (step S5). When it is determined that the application to all the number of sheets required by the recording job is not finished in step S5, the process proceeds back to step S3, and steps 3 to 5 are repeated until the application to all the number of sheets required by the recording job is completed.

When it is determined that the application to all the number of sheets required by the recording job is finished in step S5, the application roller 1001 is stopped and the drive of the pump 3007 is also stopped. Sequentially, postprocessing such as a collection operation for collecting the application liquid in the liquid retention space S and the liquid channels. Thus, processing for the application is completed.

In addition, the above collection operation is performed in the following manner. The atmosphere communication valve 3005 and the three-way valve 3006 are opened to the atmosphere. Then, by driving the pump 3007, the application liquid in the liquid retention space S and the second channel 3002 is flown into the liquid storage tank 3003. This collection operation makes it possible to reduce the vaporization of the application liquid from the liquid retention space S. After the collection operation, the atmosphere communication valve 3005 is closed, and the switching valve 3006 is switched to block off the communication between the first channel 3001 and the atmosphere communication port 3013, thereby causing the storage tank 3003 to be separated from the atmosphere. As a result, it is possible to reduce the vaporization of the application liquid from the liquid storage tank 3003. In addition to this, even if the device is inclined during being carried or transported, flowing-out of the application liquid to an outside can be reduced.

Second Embodiment

In the first embodiment, the preliminary rotation operation is performed for each sheet. However, in this embodiment, the preliminary rotation operation is not performed until the number of sheets reaches a certain threshold number of sheets. Only when the number of sheets exceeds the threshold number of sheets, the preliminary rotation operation is performed.

Figure 16:
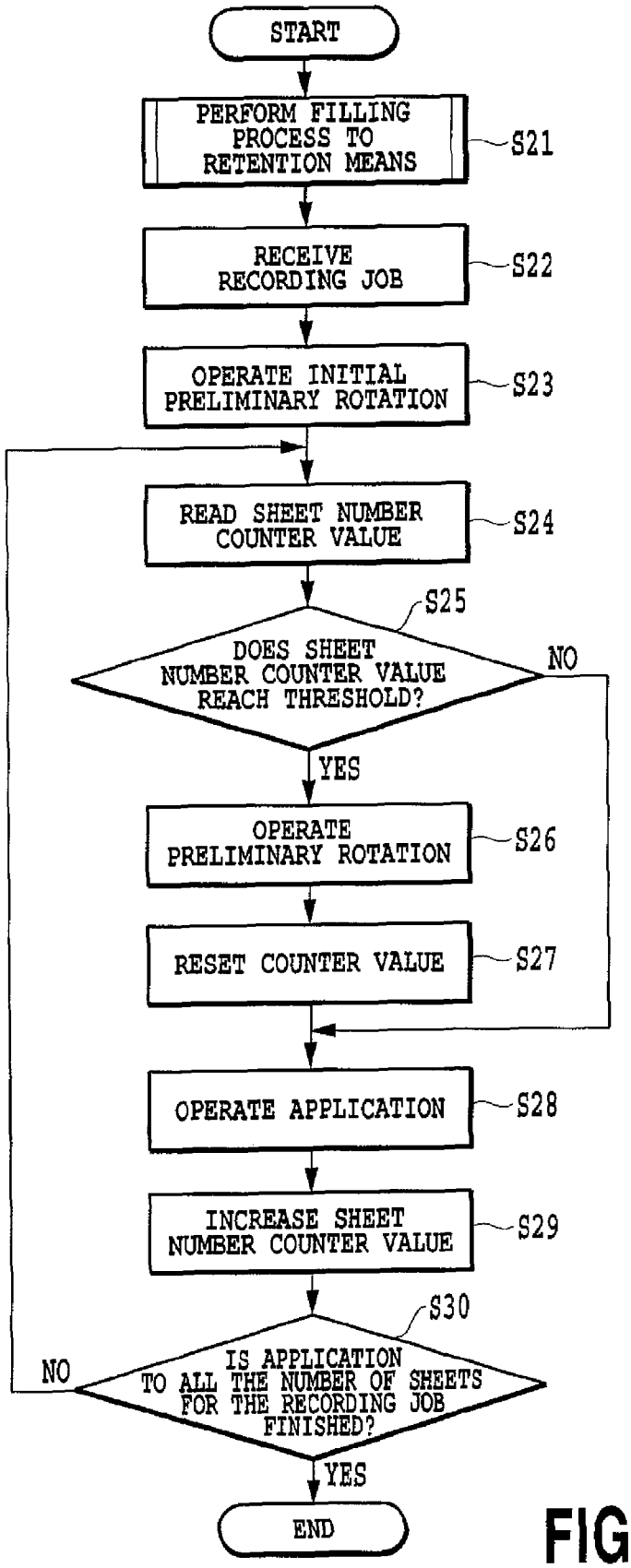
FIG. 16 is a flow chart showing a liquid-application operation sequence in an embodiment of the present invention.

FIG. 16 is a flow chart showing a procedure of liquid application in the liquid application device of this embodiment.

In FIG. 16, the processes in steps S21, S22, S26, S28, and S30 are the same as those in steps S1, and S2 to S5, respectively, shown in FIG. 13.

In this embodiment, the liquid retention member 2001 is filled with the application liquid (step S21), and then a recoding job is received (step S22). Upon receipt of the recording job, an initial preliminary rotation operation is performed to form a pool of the application liquid at a return position to the liquid retention member 2001.

In this specification, the "initial preliminary rotation operation" refers to a preliminary rotation operation, which is performed at a startup time of the device or before the application operation after a long time since the previous application operation, and in which a below-described preliminary rotation sequence corresponding to a threshold is executed. In this embodiment, with reference to the end time of the previous preliminary rotation operation, the preliminary rotation operation is performed when the number of recoding media to which the application has been performed before the current application operation reaches the same number of sheets as the threshold. The sequence for this preliminary rotation operation is a "preliminary rotation sequence corresponding to the threshold."

When the initial preliminary rotation operation is finished, a sheet number counter value stored in the RAM 4003 is read (step S24).

In this specification, the "sheet number counter value" denotes information (information on the number of recorded sheets) indicating how many application media the application has been made to since the end time of the previous preliminary rotation operation. Accordingly, the "sheet number counter value N" indicates that the application has been performed to N application media since the end of the previous preliminary rotation operation.

The sheet number counter value read in step S24 is compared with the threshold (step S25). When the sheet number counter value does not reach the threshold, the amount of application liquid is still left enough in the pool of the application liquid to function as the lubricant. Accordingly, the process goes to step S28 to perform the application operation. When the sheet number counter value reaches the threshold, the process goes to step S26 to perform the preliminary rotation operation in order to accumulate the application liquid in the pool of the application liquid.

In this embodiment, the threshold may be decided according to a balance between an image and throughput, and property of the device. The more the number of application media recorded up to the next preliminary rotation operation is, the more the threshold is. Accordingly, as shown in FIG. 17, it is preferable that the number of preliminary rotations is increased as the threshold is increased.

When the preliminary rotation operation is performed in step S26, the sheet number counter value stored in the RAM 4003 is reset to zero (step S27). Then, the application liquid is applied to the application medium with the application roller 1001 (step S28). When the application is finished, the sheet number counter value stored in the RAM 4003 is increased by "1" (step S29). When the sheet number counter value is not reset to zero in step S27, the current sheet counter number value of 1 is added to the recorded sheet number counter value.

After that, it is determined whether the application to all the number of sheets required by the recording job received in step S22 is finished (step S30). When it is determined that the application to all the number of sheets required by the recording job is not finished, the process goes back to step S24 and steps 24 to 30 are repeated until the application to all the number of sheets required by the recording job is completed. When the application to all the number of sheets required by the recording job is finished, the final step is performed. Thus, the processing for the application is completed. In this embodiment, as a criterion to decide whether the preliminary rotation operation should be performed, information on the number of recording media is used. However, there is no need to use the value of the number of recoding media itself. For example, information on the size of the recording medium (A4 size, A3 size, etc.), information on the size of recorded data or information on the transfer amount of recoding medium may be used.

Third Embodiment

In this embodiment, a preliminary rotation operation suitable for the number of recording sheets required by a recording job is performed for each recoding job.

Figure 19:
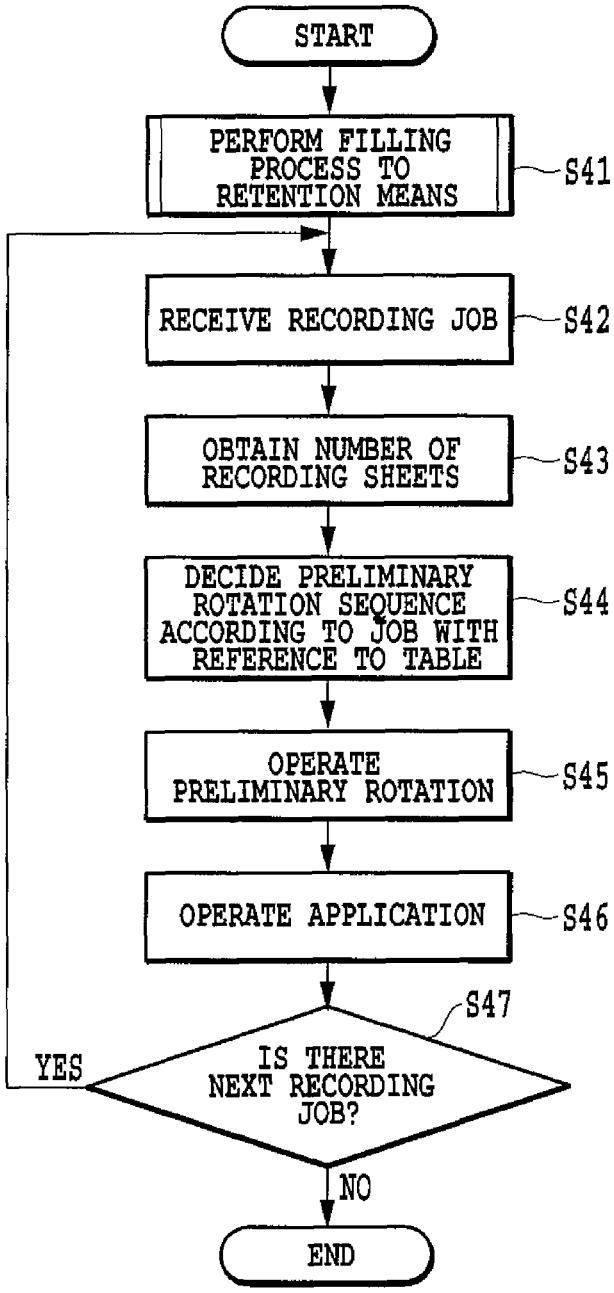
FIG. 19 is a flow chart showing a liquid-application operation sequence in an embodiment of the present invention.

FIG. 19 is a flow chart showing a procedure of liquid application of the liquid application device of this embodiment.

In FIG. 19, the processes in steps S41, S42, and S45 are the same as those in steps S1 to S3, respectively, shown in FIG. 13.

In this embodiment, the liquid retention member 2001 is filled with the application liquid (step S41), and then a recoding job is received (step S42). Upon receipt of the recording job, information on the number of recording sheets is obtained from information included in the recording job (step S43). With reference to a look-up table defined as in FIG. 20, based on the obtained information on the number of recording sheets required to be recorded by the received recording job, a preliminary rotation sequence suitable for the number of recording sheets is decided (step S44). In this embodiment, if the preliminary rotation is performed once, the application liquid necessary for one application medium to pass is accumulated in the pool of the application liquid. Accordingly, in the look-up table defined in FIG. 20, when the number of recording sheets is one, the number of preliminary rotations is set to 1. Note that, if the application liquid is not sufficiently enough accumulated by one preliminary rotation for one application medium to pass, the look-up table may be set in such a way that a suitable amount of application liquid is accumulated in the pool of the application liquid. For example, the number of preliminary rotations is set to 1.5, 2 or the like. Namely, the preliminary rotation operation is controlled to accumulate a suitable amount of application liquid in accordance with the number of recording sheets.

The preliminary rotation operation is performed based on the preliminary rotation sequence decided in step S44 (step S45), and then the application operation is performed (step S46). In the steps so far, the amount of application liquid suitable for this recording job is already accumulated in the pool of the application liquid. Accordingly, in step S46, the application operation for the number of sheets required by the recording job is performed. After that, it is determined whether there is a next recording job (step S47). When it is determined that there is the next recording job, the process goes back to step S42 to repeat steps S42 to S47. When it is determined that there is no next recording job, the final step is carried out and processing for the application is completed.

In this embodiment, the amount of application liquid suitable for the recording job is accumulated in advance based on information, included in the recording job, on the number of recording sheets. This process is performed for each recording job.

Embodiment of Ink Jet Recording Apparatus

Figure 21:
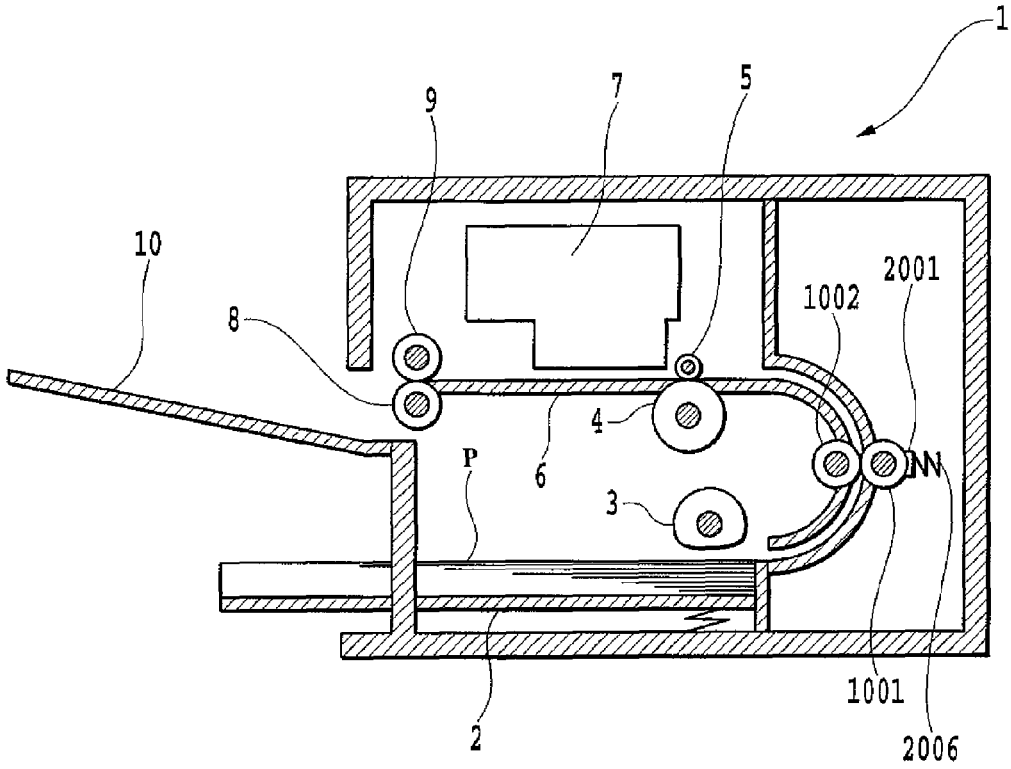
FIG. 21 is a longitudinal sectional view showing a schematic structure of an ink jet recording apparatus in an embodiment of the present invention.

FIG. 21 is a diagram showing a schematic configuration of the inkjet recording apparatus 1 including the application mechanism having almost the same configuration as that of the above liquid application device.

In the inkjet recording apparatus 1, provided is a feed tray 2 on which a plurality of recording media P are stacked, and a semi lunar shaped separation roller 3 separates the recording media P stacked on the feed tray one by one, and feeds each medium to a transfer path. In the transfer path, the application roller 1001 and the counter roller 1002 constituting the liquid application means of the liquid application mechanism are disposed. The recording medium P fed from the feed tray 2 is transferred to the interface between the rollers 1001 and 1002. The application roller 1001 is caused to rotate clockwise in FIG. 21 by the rotation of the roller drive motor, and applies the application liquid on the recording surface of the recording medium P while transferring the recording medium P. The recording medium P to which the application liquid has been applied is sent to the interface between a transfer roller 4 and a pinch roller 5. Subsequently, the counterclockwise (in this figure) rotation of the transfer roller 4 transfers the recording medium P on a platen 6, and moves the medium to a position facing a recording head 7 being an element of recording means. The recording head 7 is an inkjet recording head in which the predetermined number of nozzles for ejecting ink are arranged. While the recording head 7 scans the recording surface in a direction perpendicular to the plane of the drawing sheet, ink droplets are ejected from the nozzles to the recording surface of the recording medium P in accordance with the recorded data to perform recording. An image is formed on the recording medium while the recording operation and the transfer operation by a predetermined feed carried out by the transfer roller 4 are alternately repeated. With the image forming operation, the recording medium P is held between a sheet discharging roller 8 and a sheet discharging spur roller 9 provided downstream of the scanning region of the recording head in the transfer path of the recording media, and is discharged onto a sheet discharged tray 10 by the rotation of the sheet discharging roller 8.

As the inkjet recording apparatus, a so-called full-line type inkjet recording apparatus can be constructed, which performs the recording operation by using a long recording head which has ink-discharging nozzles arranged across the maximum width of the recording media.

The application liquid used in this embodiment is a treatment liquid for promoting the coagulation of pigment when the recording is carried out using an ink which contains pigment as a coloring material. With regard to this embodiment, the treatment liquid is used as the application liquid, so that the treatment liquid is allowed to react with the pigment as a coloring material in the ink ejected to the recording medium, to which the treatment liquid has been applied, to promote the coagulation of pigment. By promoting the coagulation of pigment, it is made possible to achieve the improvement of the recording density. In addition, it is also made possible to reduce or prevent bleeding. Needless to say, the application liquid used in the inkjet recording apparatus is not limited to the above example.

Figure 22:
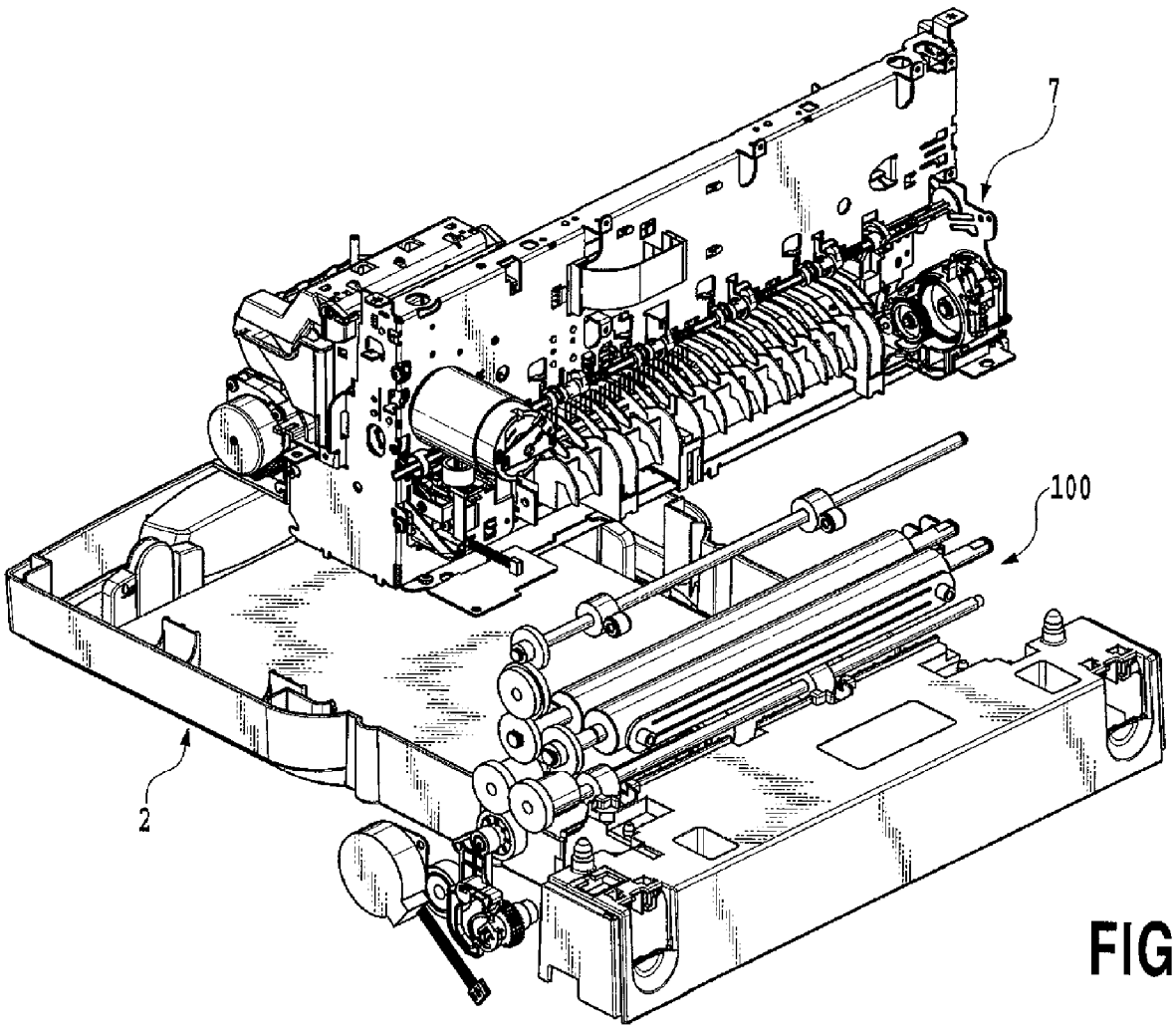
FIG. 22 is a perspective view showing a main part of the ink jet recording apparatus shown in FIG. 21.

FIG. 22 is a perspective view showing a main part of the above-described inkjet recording apparatus. As shown in this figure, an application mechanism 100 is provided above an edge of the feed tray 2, and the recording means including the recording head 7 is provided above the application mechanism and over a middle portion of the feed tray 2.

In the above-explained structure, a preliminary rotation operation is performed according to FIGS. 13, 16, 19 and the like, before an application operation in accordance with a predetermined procedure. The recording operation by the recording head 7 is performed on the recording medium P which the application has been operated in each above-mentioned procedure. In the recording operation, the recording head 7 is caused to scan the recording medium P fed by a predetermined amount each time by the transfer roller 4. Ink is ejected from the nozzles in accordance with the recorded data during this scanning. Thus, the ink adheres to the recording medium P to form dots. Since this adhering ink reacts with the application liquid, it is made possible to improve density and to prevent bleeding. Recording onto the recording medium P is performed by repeating the transfer of the recording medium and the scanning of the recording head.

Although, in the above embodiment, the description has been given of an example in which the liquid is applied using the inkjet-type recording apparatus, the present invention is applicable to a recording apparatus of another type. For example, by using a liquid containing a fluorescent brightening agent as the application liquid, it is possible to improve the brightness of the media. The recording means used after the liquid application is not limited to that of the inkjet type. The effects can be obtained also by adopting other recording types, such as the thermal-transfer type and the electrophotographic type. In addition, as the application liquid, a sensitizer may be applied before recording in a recording apparatus of the silver-halide photographic type.

Also, in the recording apparatus of the present invention, a liquid containing a fluorescent brightening agent is applied by the liquid application mechanism, making it possible to improve the brightness of the media. At this time, the recording means used after the liquid application is not limited to that of the ink jet recording type. The effects can be obtained also by adopting other recording types, such as the thermal-transfer type and the electrophotographic type.

In addition, a sensitizer may be applied before recording in a recording apparatus of the silver-halide photographic type.

In addition, in above-mentioned embodiments, the pool is formed by performing the preliminary rotation for the application rotation, but a manner for forming the pool is not limited to the preliminary rotation. For example, the pool may be formed on the area A by locating an application liquid tank on upper side of the area A and supplying the application liquid from the application liquid tank on upper side of the area A to the area A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-233274, filed Aug. 11, 2005, which is hereby incorporated by reference herein in its entirety.

What is claimed is:

1. An ink jet printing apparatus comprising:

a conveying unit configured to convey media;

an application unit that includes an application roller which applies application liquid onto the media conveyed by the conveying unit and a retention member which is provided to contact the application roller and retain the application liquid within a space so that the application liquid within the space is provided to the application roller;

a controller configured to control the application unit to rotate the application roller; and a print unit configured to print an image on the media, on which the application liquid is applied by the application unit, by ejecting ink, wherein the application roller is controlled to perform a preliminary rotation of the application roller before the media contact the application roller in order to form a pool of the application liquid on the application roller at an upstream location outside of the space in a vicinity of the retention member, wherein the controller has a counter for counting a number of the media that have been applied with the application liquid, and the controller controls the application unit to perform the preliminary rotation based on a counter value of the counter, in a case where the counter value does not reach a threshold, the controller does not perform the preliminary rotation, whereas in a case where the counter value reaches the threshold, the controller performs the preliminary rotation and resets the counter value.

2. The ink jet printing apparatus according to claim 1, wherein a rotational number of the application roller in the preliminary rotation is set in accordance with the threshold.

3. The ink jet printing apparatus according to claim 1, wherein the counter counts the number of sheets of the media.

* * * * *